US009708152B2

(12) United States Patent
Hugelier et al.

(10) Patent No.: US 9,708,152 B2
(45) Date of Patent: Jul. 18, 2017

(54) TRANSFER OF AN ELONGATED ELEMENT FROM ONE SPOOL TO ANOTHER SPOOL

(71) Applicant: NV BEKAERT SA, Zwevegem (BE)

(72) Inventors: Johan Hugelier, Harelbeke (BE); Johan Priem, Roeselare (BE)

(73) Assignee: NV BEKAERT SA, Zwevegem (BE)

( * ) Notice: Subject to any disclaimer, the term of this patent is extended or adjusted under 35 U.S.C. 154(b) by 205 days.

(21) Appl. No.: 14/412,067

(22) PCT Filed: Apr. 17, 2013

(86) PCT No.: PCT/EP2013/058013

§ 371 (c)(1),
(2) Date: Dec. 30, 2014

(87) PCT Pub. No.: WO2014/005734

PCT Pub. Date: Jan. 9, 2014

(65) Prior Publication Data

US 2015/0166288 A1 Jun. 18, 2015

(30) Foreign Application Priority Data

Jul. 4, 2012 (EP) ..... 12174962

(51) Int. Cl.
*B65H 67/052* (2006.01)
*B65H 51/20* (2006.01)
*B65H 65/00* (2006.01)

(52) U.S. Cl.
CPC ..... *B65H 67/052* (2013.01); *B65H 51/20* (2013.01); *B65H 65/00* (2013.01); *B65H 2701/36* (2013.01)

(58) Field of Classification Search
CPC .. B65H 67/052; B65H 67/044; B65H 67/048; B65H 67/056; B65H 65/00; B65H 51/20; B65H 2701/36
See application file for complete search history.

(56) References Cited

U.S. PATENT DOCUMENTS 3,596,844 A 8/1971 Engmann
4,098,467 A 7/1978 Engmann et al.
(Continued)

FOREIGN PATENT DOCUMENTS

DE 3810875 A1 10/1989
EP 0 181 960 A1 5/1986
(Continued)

OTHER PUBLICATIONS

Machine Translation of EP 0 181 960 A1, May 28, 1986.*

*Primary Examiner* — William E Dondero
(74) *Attorney, Agent, or Firm* — Foley & Lardner LLP

(57) ABSTRACT

An elongated element (10) is transferred from a second (full) spool (13) to a first (empty) spool (14). A gripper (16) is positioned on the elongated element (10). The gripper (16) catches the elongated element (10) and the elongated element (10) is cut between the gripper (16) and the second spool (13) thereby leaving a leading end (19). Thereafter the gripper (16) is positioned with the leading end (19) at the level of the first empty spool (14). The gripper (16) is rotating around the axis of the first spool (14) to form first windings to fix the elongated element (10) on the first spool (14). The method allows full automation and assures the use of the wound element (10) until its final end.

13 Claims, 3 Drawing Sheets

(56) References Cited

U.S. PATENT DOCUMENTS

Figure 1A:
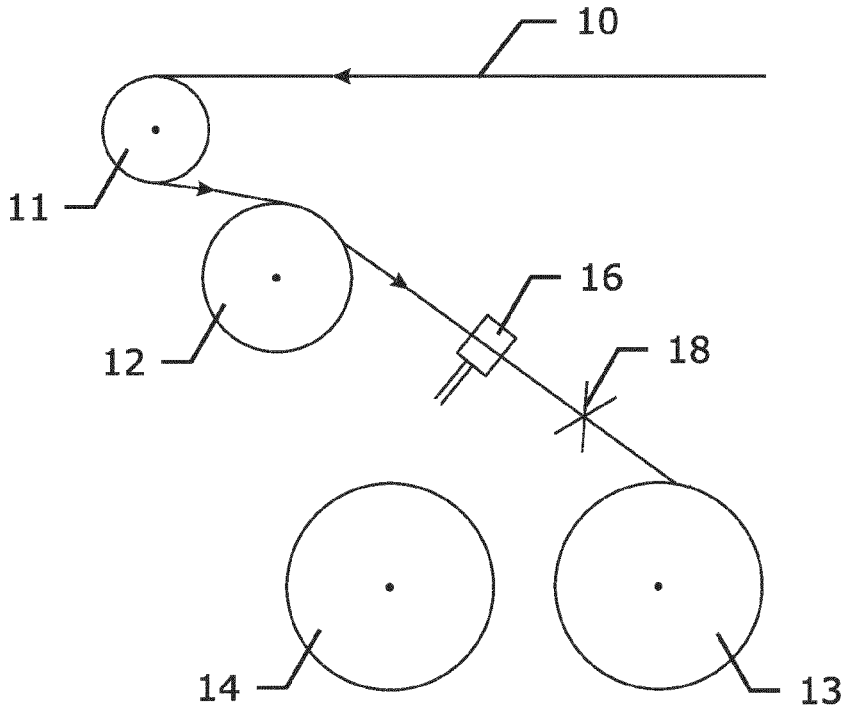

| | | | | |
|---|---|---|---|---|
| 4,477,033 | A | 10/1984 | Kotzur et al. | |
| 4,938,428 | A | 7/1990 | Zaman et al. | |
| 4,971,264 | A | 11/1990 | Lepach et al. | |
| 2003/0173448 | A1* | 9/2003 | Angold | B65H 65/00<br>242/474.4 |
| 2004/0193303 | A1* | 9/2004 | Fore, Sr. | B65H 67/052<br>700/126 |

FOREIGN PATENT DOCUMENTS

| | | |
|---|---|---|
| GB | 1 207 321 | 9/1970 |
| GB | 1 456 638 | 11/1976 |
| GB | 2 027 076 A | 2/1980 |

* cited by examiner

TRANSFER OF AN ELONGATED ELEMENT FROM ONE SPOOL TO ANOTHER SPOOL

TECHNICAL FIELD

The invention relates to method of transferring an elongated element from a full spool to an empty spool during continuous supply of the elongated element.

BACKGROUND ART

A lot of prior embodiments and a lot of knowledge is available in the art of to automated spool exchanges.

U.S. Pat. No. 4,477,033 is disclosing a winding machine for the continuous winding of flexible material on spools mounted on first and second independently operable spindles. Once a first spool has been filled, the flexible material is transferred to the second spool. On this second spool, close to the core, in the flange of the spool, is a grabber and cutter mechanism positioned. So the flexible material is only grabbed and cut once it is in contact with the second spool. The grabber and cutter mechanism comprise a piston, a piston cylinder, an arm and a movable flange. The building of this grabber and cutter mechanism in or on the spools complicates the embodiment. In addition, this embodiment only allows to transfer the flexible material from the first spool to the second spool and vice versa.

U.S. Pat. No. 4,938,428 discloses a wire winding system with a plurality of stations. Each station has a single take-up turntable driven by a variable speed motor. A mobile transfer cart is moveable to a selected station to carry out a wire transfer. The wire is transferred from the full spool on the turntable to the mobile transfer cart. The full spool is removed and replaced by an empty spool. Thereafter the mobile transfer cart effects the transfer of the winding wire to the empty spool on the turntable.

U.S. Pat. No. 4,971,264 discloses a method and apparatus for the continuous changing of reels on continuously operating stationary winding stations for strand-like material. In order to initiate a reel exchange, a full reel and an empty reel are connected to one another by means of a rotatable arm. The arm rotates and puts the full reel in place of the empty reel and vice versa, while the strand-like material is still being wound on the full spool. The strand-like material is cut and fixing and winding upon the empty reel can start. Thereafter the full reel and the rotatable arm are removed from the winding position. The connection of the full reel and the empty reel during continuous winding operation as well as the removal of the full spool also during continuous winding operation requires a rather complex mechanism.

DE-A1-38 10 875 discloses an improvement to the embodiment with the rotatable arm of U.S. Pat. No. 4,971,264. The rotatable arm is installed on a rail and is moveable along a series of winding stations. Only one rotatable arm mechanism is required for a plurality of winding stations.

GB 1207321 and GB 1456638 both disclose methods of transferring a wire or a strand from one spool to another spool. In GB 1207321 the uncut wire is snagged on the shaft of the empty spool and only thereafter the wire is cut. Similarly, in GB 1456638 the uncut strand is caught between catcher plates adjacent one of the flanges of the empty spool. These methods have two drawbacks. A first drawback is that after the wire or strand has been snagged or caught and cut, the trailing end of the wire or strand is relatively long since this trailing end bridges the distance between the two spools. As long as the full spool is still rotating, this long trailing end may cause problems. A second drawback is experienced during unwinding. Since the leading end of the wire or strand is caught either on the shaft of the empty spool or between catcher plates, the wire or strand cannot be kept on or near the core of the spool until the very last winding. On the contrary, a relatively long loose end is formed. This long loose end is often referred to as a 'pig tail' and is to be avoided.

DISCLOSURE OF INVENTION

The primary object of the invention is to avoid the disadvantages of the prior art. Another object of the invention is to provide an alternative embodiment for automated transfer of an elongated element from one full spool to an empty spool.

Still another object of the invention is to realize a transfer of an elongated element from one spool to another without interrupting the supply of the elongated element and even without decreasing the speed of supply of the elongated element.

Yet another object of the present invention is to simplify the apparatus and method of transferring an elongated element from one spool to another.

According to the invention there is provided a method of transferring an elongated element from a second spool to an first spool during continuous supply of the elongated element. The method comprises the following steps:

a) guiding an elongated element to a second spool e.g. by means of a capstan and one or more pulleys;
b) winding the elongated element on the second spool;
c) providing a first empty spool adjacent to the second spool;
d) positioning a gripper on the elongated element upstream the second spool;
e) once the second spool has reached a sufficient degree of filling or once an operator or an automated system decides to transfer the wire to an adjacent spool, gripping the elongated element by means of the gripper and cutting the elongated element between the gripper and the second spool thereby leaving a leading end of the elongated element;
f) positioning the gripper with the leading end at the level of the first empty spool;
g) rotating the gripper around the axis of the first spool to form windings of the elongated element on the first spool and fixing the elongated element on the first spool;
h) having the gripper releasing the elongated element.

Within the context of the present invention, the term 'spool' also refers to a reel or a bobbin.

Also within the context of the present invention, the terms 'elongated element' refer to a wire, cord, yarn, rope or cable, more particularly to a metal wire, metal cord, metal yarn, metal rope or metal cable, and most particularly to a steel wire, steel cord, steel yarn, steel rope or steel cable, thereby also referring to hybrid structures with both metal and non-metal parts.

Still within the context of the present invention, the terms 'sufficient degree of filling' refer to a range of 80% to 100% of the maximum capacity of the spool, e.g. to a range of 90% to 100%.

The term "capstan" refers to any device which provides the driving or tensile force to bring the elongated elements to the spools.

The invention is particularly advantageous for multi-wire coating installations such as lacquering installations for metal wires or for electro-plating or chemical plating installations for steel wires. The diameters of these metal wires or steel wires may range from 0.50 mm to 3.50 mm, e.g. from 0.65 mm to 2.00 mm. The linear speed of supply of these wires to the winding units may range from 50 m/min, e.g. from 65 m/min up to 100 m/min and even 120 m/min and more.

The method of the invention has the advantage of offering a simple mechanism to transfer an elongated element from one spool to an adjacent spool. As will be explained hereinafter, the invention allows this transfer without decrease in speed of supply of the elongated element. In addition, depending upon the particular way of fixing the elongated element to the empty spool, an accumulator may be skipped or left out.

The invention does not require a complex mechanism for fixing the leading end of the elongated element on the empty spool.

The invention does not require a temporary storage of the elongated element since the transfer is directly made to the empty spool.

Another particular advantageous aspect of the invention is that there is no need for a rotatable arm or rotation table carrying the spools and exchanging the position of the spools. Hence, there is no severe limit as to weights of the spools. The invention is applicable to spools of relatively high weights.

The method of the invention separates the step of spool change from the step of transfer of elongated element.

Finally, the method of the invention allows full automation of the transfer of the elongated element.

The fixing of the elongated element on the first spool may be realized in various ways.

This may be done by means of a glue attached to the leading end of the elongated element and binding—at least during storage—the elongated element on the core of the spool.

This may also be done by means of an adhesive tape which may be attached in advance on the core of the spool. This adhesive tape may partially or totally cover the surface of the core of the spool.

Another alternative is the use of a hole in the core of the spool. The leading end is provided with a short and sharp bent part directed downwards. This bent part is put in the hole, e.g. with the help of an optical sensor.

One may also make use of a clip on the core or on one of the flanges of the second spool, preferably close to the core of the spool. The clip may function as a spring pushing the leading end of the elongated element against the core or against the flange of the spool.

Still another way to fix the elongated element on the first spool is to bend the leading end of the elongated element and to form at least one or more of the first windings over this bent part. The term "winding" refers to a 360° revolution of the elongated element on the spool.

The fixing of the elongated element on the first spool may also be a combination of one or more of the above-mentioned ways.

In one embodiment of the invention the first spool is at a standstill during fixing the elongated element on this first spool or, alternatively, is rotating at a speed that is lower than the rotational speed needed to take up directly—i.e. without intermediate storage—all elongated element coming from the capstan or pulleys. In this embodiment, the elongated element is temporarily kept in an accumulator in order to guarantee continuous supply of the elongated element at equal speed. This accumulator is positioned upstream the capstan. The accumulator may be formed by a guiding pulley which travels over a rail and keeps the tension in the elongated element substantially constant.

In another advantageous and preferable embodiment of the invention the first spool is rotating at a speed adapted to take directly—i.e. without intermediate storage or accumulator—all elongated element coming from the capstan and pulleys.

The method of the invention is suitable for installations of multiple elongated elements, i.e. more than two. In case the first transfer of elongated element is from the second spool to a first spool, the second transfer may be from the third spool to a second spool. The third transfer may be from a fourth spool to a third spool.

The method of the invention is also suitable for installations with two spool positions for each elongated element. In case the first transfer of elongated element is from the second spool to a first spool, the second transfer is then from the first spool to a second spool and the third transfer again from the second spool to a first spool.

In a preferable embodiment of the invention, in step g) the first windings on the empty spool are carried out under an increased winding tension. The advantage hereof is experienced during unwinding. The increased winding tension provides that the elongated element stays on the spool until the last winding thereby helping to avoid the so-called pig tail.

BRIEF DESCRIPTION OF FIGURES IN THE DRAWINGS

Figure 1B:
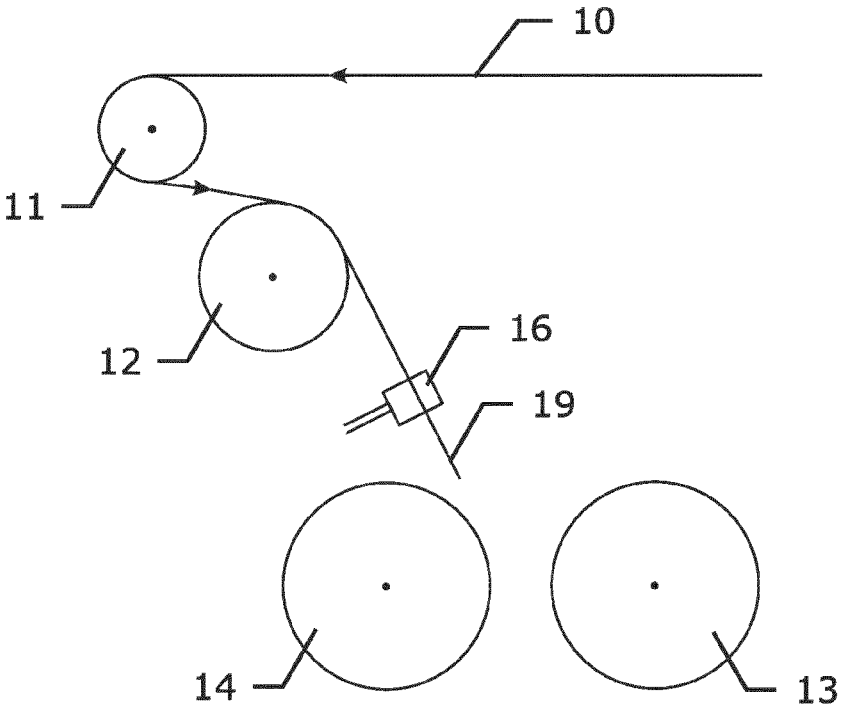
Figure 1C:
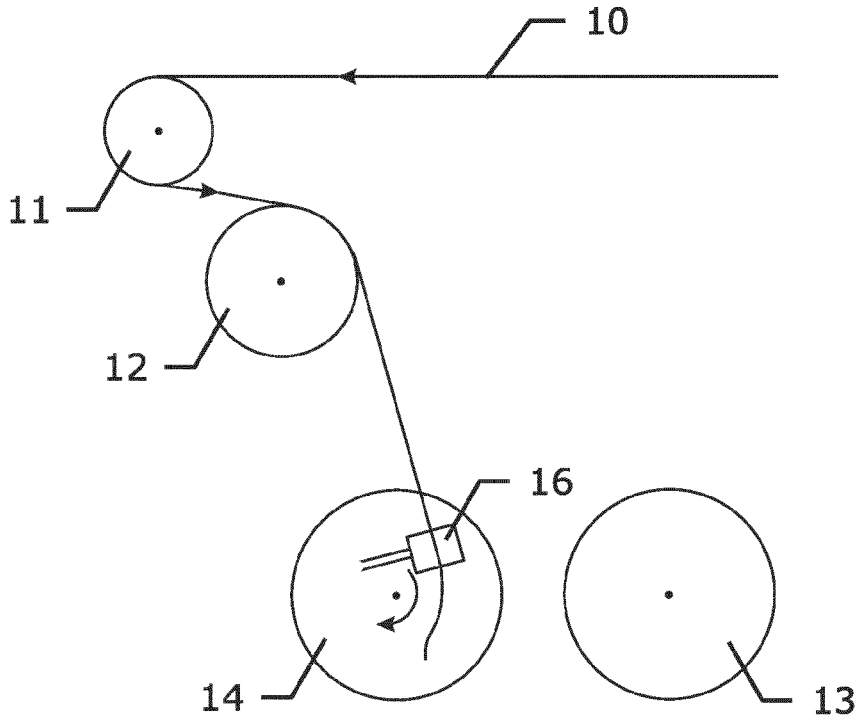
Figure 2A:
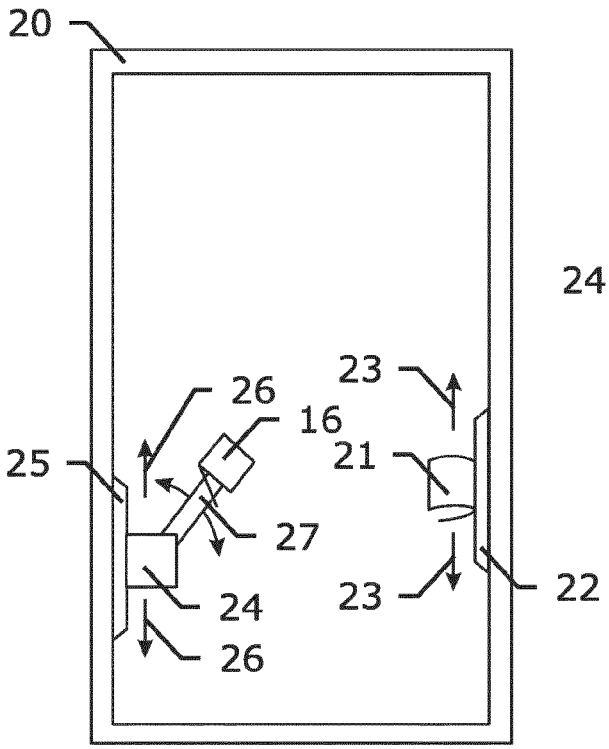
Figure 2B:
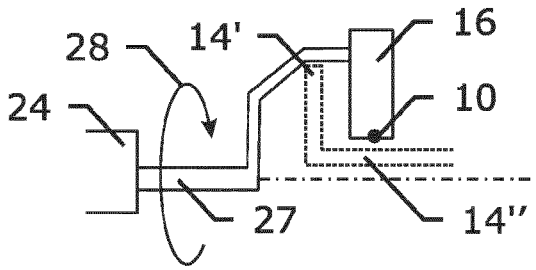
Figure 3:
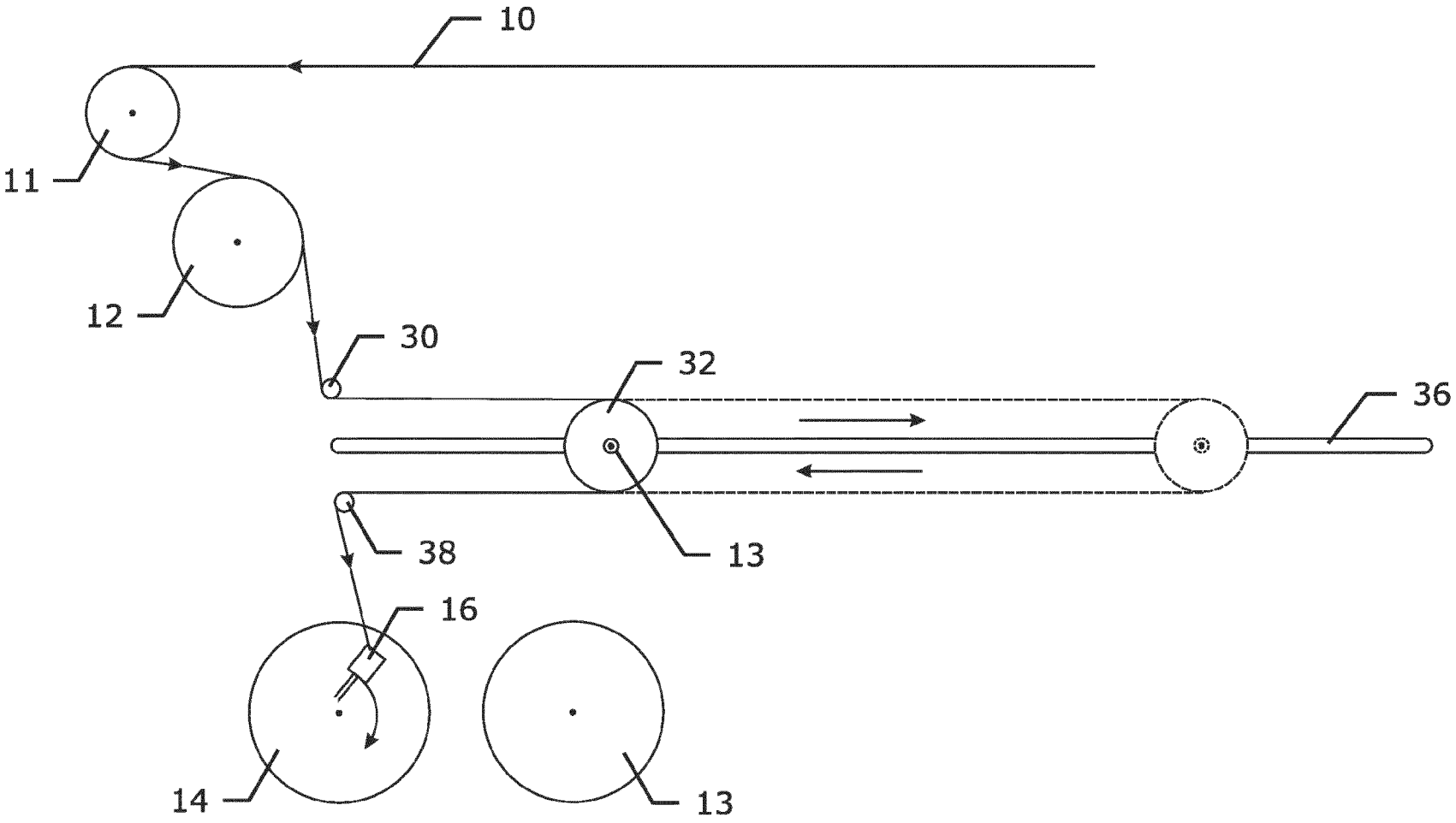

FIG. 1*a*, FIG. 1*b* and FIG. 1*c* illustrate subsequent steps in a way of transferring a steel wire from one spool to an adjacent spool;

FIG. 2*a* shows a front view of a frame where a gripper and a cutter are installed;

FIG. 2*b* shows a side view of a gripper;

FIG. 3 illustrates the way of working of a wire accumulator.

MODE(S) FOR CARRYING OUT THE INVENTION

FIG. 1*a* illustrates a first step in a wire transfer from a spool to an adjacent spool.

A steel wire 10 is guided over a pulley 11 and driven by a capstan 12 to be wound upon a second spool 13. Adjacent to the second spool 13 is a first and empty spool 14. The axes of the second spool 13 and of first spool 14 are parallel. Spools 13 and 14 are driven independently from one another. A little time before the second spool 13 is full or after an operator has given the instruction to transfer the wire 10, a wire gripper 16 is positioned downstream the capstan 12 close to the wire 10, e.g. by surrounding the wire 10. The gripper 16 is not yet touching or gripping the wire. The gripper may be made of a hard metal such as tungsten carbide.

A cutter 18 is positioned downstream the gripper 16 ready to cut the wire 10.

The position of the gripper 16 close to the steel wire 10, just before capturing the wire 10, may be determined optically or may be calculated after measuring the speed of supply of steel wire 10 and the rotation speed of the second spool 13. It is hereby understood that the lower this latter rotation speed is, the more full the spool 13 and the lower the angle the steel wire 10 makes with a horizontal line between the capstan 12 and the second spool 13.

At a given moment the gripper 16 captures the steel wire 10 and the cutter 18 cuts the steel wire 10.

FIG. 1*b* illustrates a second step in a wire transfer from a second spool 13 to a first spool 14 just after the steel wire 10 has been cut leaving a leading end 19 of the steel wire 10 at one end of the gripper 16. The gripper 16 travels with the steel wire 10 from second spool 13 to first spool 14.

In a preferable embodiment of the invention, this travelling is at such a high speed that the linear supply speed of steel wire 10 remains unchanged and that there is no need for an accumulator.

If this high travelling speed cannot be reached, an accumulator is preferably used so that the linear supply speed of steel wire 10 remains unchanged and that the processes upstream can be left untouched.

FIG. 1*c* illustrates a third step in a wire transfer from a second spool 13 to a first spool 14.

The gripper 16 rotates a few rotations together with the first spool in order to fix the steel wire 10 with its leading end 19 to the empty spool 14. As mentioned, this is preferably done under an increased winding tension.

As also mentioned above, this fixing may be done in various ways.

After a few rotations of the gripper 16 with the spool 14, the gripper 16 releases the steel wire 10 and takes a position more remote from the first spool 14.

After this transfer of wire the second spool 13 filled with steel wire 10 may be removed and replaced by an empty spool.

FIG. 2*a* and FIG. 2*b* illustrate how the movement and positioning of the gripper 16 and the cutter 18 may be realized.

FIG. 2*a* shows a front view of a frame 20. This frame 20 can travel horizontally along the positions of the spools. The frame 20 may travel on wheels (not shown) or the frame 20 may be hung on a rail (not shown).

A cutter basis 21 is installed via a support 22 on a vertical arm of the frame 20. Cutter 18 is connected to the cutter basis 21 (not shown). The cutter basis can travel vertically in the direction of arrows 23 along the arm of the frame 20. This vertical movement may be realized by means of rails or by means of wheels.

The horizontal movement of the frame 20 together with the vertical movement of the cutter basis 21 allow to position the cutter 18 where it is desired.

A gripper basis 24 is installed via a support 25 to another vertical arm of the frame 20. Gripper 16 is connected to this basis 24. The gripper basis 24 can travel vertically in the directions of arrows 26 along the arm of the frame 20. Gripper 16 is connected to its basis 24 via an arm 27 which may rotate in the direction of arrows 28.

The horizontal movement of the frame 20 together with the vertical movement of gripper basis 24 allow to position the gripper 16 close to or around the steel wire 10. The rotational movement allows to perform a number of revolutions of the gripper 16 with a steel wire 10 around a spool.

FIG. 2*b* gives a side view of the arrangement of gripper 16. As already mentioned, gripper 16 is connected through an arm 27 to a gripper basis 24. Arm 26 can rotate in the direction of arrow 28. A first part of arm 27 is positioned in line with the rotation axis of the first spool 14. A second part of arm 27 deviates from this axis line and allows gripper 16 to bring steel wire 10 over flange 14' to core 14" of first spool 14. Alternatively, the leading end of steel wire 10 may also be fixed to the inner side of the flange 14', preferably close to the core 14".

Depending upon the way of fixing the leading end of the steel wire to the empty spool 14, empty spool 14 may stand still or may rotate at a lower speed than needed to take up all steel wire 10 without decreasing the supply speed of the steel wire 10. In this case a wire accumulator may be used.

FIG. 3 illustrates the principal working of one type of wire accumulator.

Steel wire 10 is driven by capstan 12 and is guided over a first fixed pulley 30 and makes a 180° turn over a travelling pulley 32. Via a second fixed pulley 38 the steel wire is brought to the first spool 14.

Pulley 32 may travel horizontally, e.g. by means of its axe being positioned in a horizontal groove 36.

During this horizontal travelling to the right side, the tension in steel wire 10 is kept constant and wire length is accumulated.

During the travelling to the left side, the accumulated length of steel wire 10 is decreased, because the first spool 14 is rotating at a higher speed.

LIST OF REFERENCE NUMBERS

10 steel wire
11 guiding pulley
12 capstan
13 second (full) spool
14 first (empty) spool
14' flange of first spool
14" core of first spool
16 gripper
18 cutter
19 leading end of steel wire
20 frame
21 cutter basis
22 support
23 arrows indicating vertical direction
24 gripper basis
25 support
26 arrows indicating vertical direction
27 gripper arm
28 arrows indicating rotational movement
30 first fixed guiding pulley
32 travelling guiding pulley
34 axe of travelling guiding pulley
36 groove
38 second fixed guiding pulley

The invention claimed is:

1. A method of transferring an elongated element from a second spool to a first spool, said method comprising the steps of:

a. guiding the elongated element to the second spool;
b. winding said elongated element on said second spool;
c. providing the first spool adjacent to said second spool;
d. positioning a gripper on said elongated element upstream of said second spool;
e. gripping said elongated element by said gripper and cutting said elongated element between said gripper and said second spool, thereby leaving a leading end of said elongated element, without changing a linear supply speed of said elongated element;
f. positioning said gripper with said leading end at a level of said first spool;
g. rotating said gripper around an axis of said first spool to form first windings of said elongated element on said first spool and fixing said elongated element on said first spool; and
h. causing said gripper to release said elongated element, wherein the elongated element is continuously supplied during transfer from the second spool to the first spool.

2. A method according to claim 1, wherein said first spool has a core and two flanges; and wherein fixing said elongated element on said first spool is done by at least one of glue, adhesive tape, a hole in the core of said first spool, a clip on the core or on one of the flanges of said first spool, bending the leading end of the elongated element and forming windings of the elongated element over said bent end, or any combination thereof.

3. A method according to claim 1, wherein said first spool is at a standstill during fixing of the elongated element on said first spool.

4. A method according to claim 3, wherein the elongated element is temporarily kept in an accumulator to provide a continuous supply of the elongated element.

5. A method according to claim 4, wherein said accumulator is formed by a guiding pulley which travels over a rail and keeps tension in the elongated element substantially constant.

6. A method according to claim 1, wherein said first spool is rotating at a rotational speed during fixing of the elongated element on said first spool such that a need for an accumulator is avoided.

7. A method according to claim 1, wherein steps a. to h. are repeated with a second spool instead of a first spool and a third spool instead of a second spool.

8. A method according to claim 1, wherein steps a. to h. are repeated with a second spool instead of a first spool and a first spool instead of a second spool.

9. A method according to claim 1, wherein said method is automated.

10. A method according to claim 1, wherein said first windings of said elongated element on said first spool are carried out under tension that is increased relative to tension applied during other winding to minimize loose ends during unwinding.

11. A method according to claim 1, wherein said first windings of said elongated element on said first spool are carried out under a first tension that is higher than a tension at which a subsequent winding is carried out.

12. A method according to claim 1, wherein said gripper comprises tungsten carbide.

13. A method according to claim 1, further comprising providing the gripper at a first location while the gripper rotates together with the first spool, and thereafter providing the gripper at a second location that is farther from the first spool than the first location.

* * * * *